US009865147B2

(12) United States Patent
Langford et al.

(10) Patent No.: US 9,865,147 B2
(45) Date of Patent: Jan. 9, 2018

(54) COLLISION WARNING SYSTEM

(71) Applicants: David Langford, Madison, AL (US); Joseph McGinty, Madison, AL (US)

(72) Inventors: David Langford, Madison, AL (US); Joseph McGinty, Madison, AL (US)

( * ) Notice: Subject to any disclaimer, the term of this patent is extended or adjusted under 35 U.S.C. 154(b) by 0 days.

(21) Appl. No.: 15/438,443

(22) Filed: Feb. 21, 2017

(65) Prior Publication Data

US 2017/0243458 A1 Aug. 24, 2017

Related U.S. Application Data

(60) Provisional application No. 62/297,909, filed on Feb. 21, 2016.

(51) Int. Cl.

| | |
|---|---|
| ***G08G 1/095*** | (2006.01) |
| ***G08B 21/02*** | (2006.01) |
| *G08B 13/08* | (2006.01) |

(52) U.S. Cl.

CPC ..... *G08B 21/02* (2013.01); *G08B 13/08* (2013.01)

(58) Field of Classification Search

CPC ..... G08B 21/02; G08B 13/08

See application file for complete search history.

(56) References Cited

U.S. PATENT DOCUMENTS 4,438,428 A * 3/1984 Ober ..... G08B 17/107 340/517
4,481,887 A * 11/1984 Urbano ..... E05G 5/02 109/3
4,623,878 A * 11/1986 Schoenwetter ..... A47G 33/04 340/522
4,757,430 A * 7/1988 Dubak ..... F21S 8/035 361/175
4,872,095 A * 10/1989 Dubak ..... F21V 23/0442 362/100
4,993,049 A * 2/1991 Cupps ..... G06M 1/101 250/338.1
5,153,560 A 10/1992 Ichikawa
5,453,736 A * 9/1995 Noren ..... G05B 19/409 340/5.6
5,861,806 A * 1/1999 Vories ..... G08B 5/36 340/545.3
5,996,281 A * 12/1999 Takano ..... G01V 8/14 49/26
6,154,130 A * 11/2000 Mondejar ..... G08B 13/08 340/321
6,292,100 B1 * 9/2001 Dowling ..... G08B 13/08 340/545.1
6,341,563 B1 * 1/2002 Gal ..... B61D 19/026 104/28
6,970,085 B2 * 11/2005 Okabe ..... E05F 15/43 340/480

(Continued)

*Primary Examiner* — Joseph Feild
*Assistant Examiner* — Rufus Point
(74) *Attorney, Agent, or Firm* — Patent Grove LLC; Tomas Friend

(57) ABSTRACT

A self-contained collision warning device warns of possible collisions between people and between people and moving objects on opposite sides of doors and other visual barriers. Motion sensors detect the presence of people or moving objects and activate indicators that warn of the presence of unseen people and moving objects. The device can be mounted to a door or wall without modification to the door or wall or access to electrical power.

9 Claims, 11 Drawing Sheets

(56) References Cited

U.S. PATENT DOCUMENTS 7,068,179 B2 * 6/2006 Snell ..... E05F 3/224 340/686.6
7,318,298 B2 * 1/2008 Marsden ..... E06B 9/04 362/152
8,141,296 B2 * 3/2012 Bem ..... E05B 47/02 340/686.6
8,510,990 B2 * 8/2013 Agam ..... G01S 15/04 49/26
8,819,992 B2 * 9/2014 De Coi ..... E05F 15/203 49/25
9,163,446 B2 * 10/2015 Houser ..... E05F 3/22
9,595,175 B1 * 3/2017 Thoney ..... G08B 13/08
2003/0222785 A1 * 12/2003 Weinstein Ide ..... A47K 17/00 340/692
2004/0140782 A1 * 7/2004 Okabe ..... E05F 15/43 318/445
2005/0140319 A1 * 6/2005 Takashima ..... E05F 15/74 318/286
2006/0162254 A1 * 7/2006 Imai ..... E05F 15/73 49/26
2008/0061969 A1 * 3/2008 Okude ..... G08B 13/10 340/541
2009/0300988 A1 * 12/2009 Bem ..... E05B 47/02 49/340
2010/0277089 A1 * 11/2010 Chien ..... H04N 5/2354 315/287
2011/0080252 A1 * 4/2011 Ibsies ..... E05B 41/00 340/3.1
2011/0107633 A1 * 5/2011 Wells ..... G09F 13/04 40/572
2011/0138664 A1 * 6/2011 Wells ..... G09F 13/04 40/541
2011/0227746 A1 * 9/2011 Houser ..... E05F 3/22 340/686.1
2011/0273290 A1 * 11/2011 Gilchrist ..... E06B 5/10 340/545.1
2013/0083517 A1 * 4/2013 Bratton ..... F21V 33/006 362/191
2014/0003034 A1 * 1/2014 Lien ..... F21V 23/003 362/98

* cited by examiner

COLLISION WARNING SYSTEM

CROSS-REFERENCE TO RELATED APPLICATIONS

This application claims priority to the U.S. provisional application 62/297,909 filed Feb. 21, 2016.

BACKGROUND OF THE INVENTION

Field of the Invention

The present invention relates to apparatus and methods for warning people on opposite sides of visual barriers of a possible collision. The visible barriers may include doors, blind corners, and other visual obstructions around which people move with the possibility of colliding with another person or a movable object carried or rolled by a person. The collisions avoided may involve, for example, people, plates of food, containers of liquids, fragile objects, wheelchairs, carts, carried trays, rolling trays, gurneys, and combinations thereof.

Discussion of Related Art

The opening of doors continues to cause injuries to persons and damage to objects when doors are opened by a person on one side of the door while a person or moving object is on the opposite side of the door. When a person is about to operate a door from one side, they normally cannot determine whether or not a person or movable object carried or pushed by another person is on the other side of the door. As a consequence, the potential exists that the door may strike a person or movable object on the opposite side of the door. Similarly, people moving along or past a visual barrier, such as a wall or screen, may collide with other people or movable objects moving toward them from the other side of the visual barrier. It is therefore desirable to prevent injury and damage when people and/or movable objects approach each other from adjacent areas that are mutually not visible to one another.

One solution to the problem as it relates to adjacent areas on opposite sides of a door is to place a window in the door so that a person about to open the door may observe activity on the opposite side before opening the door. This solution is not practical if the door is intended to provide privacy and/or security. Furthermore, where doors are opened quickly or people are moving quickly, it may be that a visual assessment through a window does not provide sufficient warning of a potential collision. One reason for this is that, the person opening the door must actively look through the window and assess what is observed. This may difficult when the area on the other side of the door is poorly lit or when the person opening the door or the person/object on the other side of the door is moving quickly.

One solution related to adjacent areas around blind corners in hallways and adjacent areas on different sides of other visual obstructions is to place a convex mirror such that people moving from opposite sides of the obstruction can see one another. This solution has the advantages of being simple and inexpensive but suffers form the drawbacks including not functioning well if one or both sides of the obstruction are poorly lit and that it requires each person to actively look at objects in the mirror to determine if anything or anyone is moving or obstructing the opposite side of the visual barrier.

U.S. Pat. No. 6,292,100 discloses a door warning system comprising a sensor for sensing people immediately adjacent to one side of a swinging door and a visual or auditory indicator on the other side of the door to warn a person about to open the door from the other side of the swinging door. A radar sensing unit projects a sensing beam downwardly from a wall adjacent to the door and into a roughly circular area slightly larger than the arc through which the door swings and triggers the indicator if a person is detected in the area. Sensors can be placed in the wall on both sides of the door to activate indicators on opposite sides of the door. The indicators may be located at a position on a wall adjacent a door. The '100 door warning system requires that the sensor be mounted to a stationary wall and modifications to the wall for installation of the sensor and sensor power supply and, in some cases, the indicator and indicator power supply. If the indicator is not mounted in the wall, the door must be modified for mounting the indicator and indicator power supply.

U.S. Pat No. 5,861,806 describes a battery powered indicator for detecting the presence of a person in area behind a door. This is useful, for example, for signalling that a restroom is occupied. The indicator is installed on a door such that a light source on one side of the door provides a visual signal indicating the presence of a person on the other side of the door when the door is closed. The indicator is screwed to a top edge of the door via a mounting bracket thin enough to fit within a pre-existing gap between the top of a door and the door frame. The bracket projects beyond an inside surface of the door enough to support a casing on the side of the door where a person is to be detected. A wire lever extending upward from the casing controls a switch that actuates a switch to confirm that the door is closed. A timer limits the time that the indicator illuminates to conserve battery power. Additionally, a ten second delay between door closing the door any activation of the indicating light prevent false positive signals and conserves battery power. Additionally, a timer is used to turn the indicating light off after a predetermined time to slow battery depletion.

The present invention ameliorates drawbacks associated with existing door collision warning systems and provides for an inexpensive and simple device and method for actively warning of possible a collision resulting from the opening of a door. The invention additionally provides for a collision warning device that detects a condition for possible collision between people and/or movable objects moving toward one another around a blind corner or other visual barrier.

BRIEF SUMMARY OF THE INVENTION

In one aspect, the invention provides for a self-contained device that is hung over the top of a door and provides a visible and/or audible indication on both sides of the door that the possibility of a collision exists when a person opens the door, whether anyone is on the other side or not. In another aspect, the invention provides for a self-contained device that is hung over the top of a door and provides a visible and/or audible indication that the possibility of a collision exists when people and or movable objects are present on both sides of the door whether the door is opened or not.

In another aspect, the invention provides for a self-contained device that is attached to a wall or other barrier in apposition to an intersection of two areas in which the visibility of each area from the other is obstructed by the barrier. As an example, the device may be mounted to an outside corner formed by the joining of two walls where two rooms or passages meet. The device provides a visible and/or audible indication that the possibility of a collision exists when people and or movable objects are present on, or approach the device from, either side of the corner. These and other aspects of the invention are described in detail below

BRIEF DESCRIPTION OF THE DRAWINGS

The elements of the drawings are not necessarily to scale relative to each other, with emphasis placed instead upon clearly illustrating the principles of the disclosure. Like reference numerals designate corresponding parts throughout the several views of the drawings in which.

DETAILED DESCRIPTION OF THE INVENTION

Figure 1:
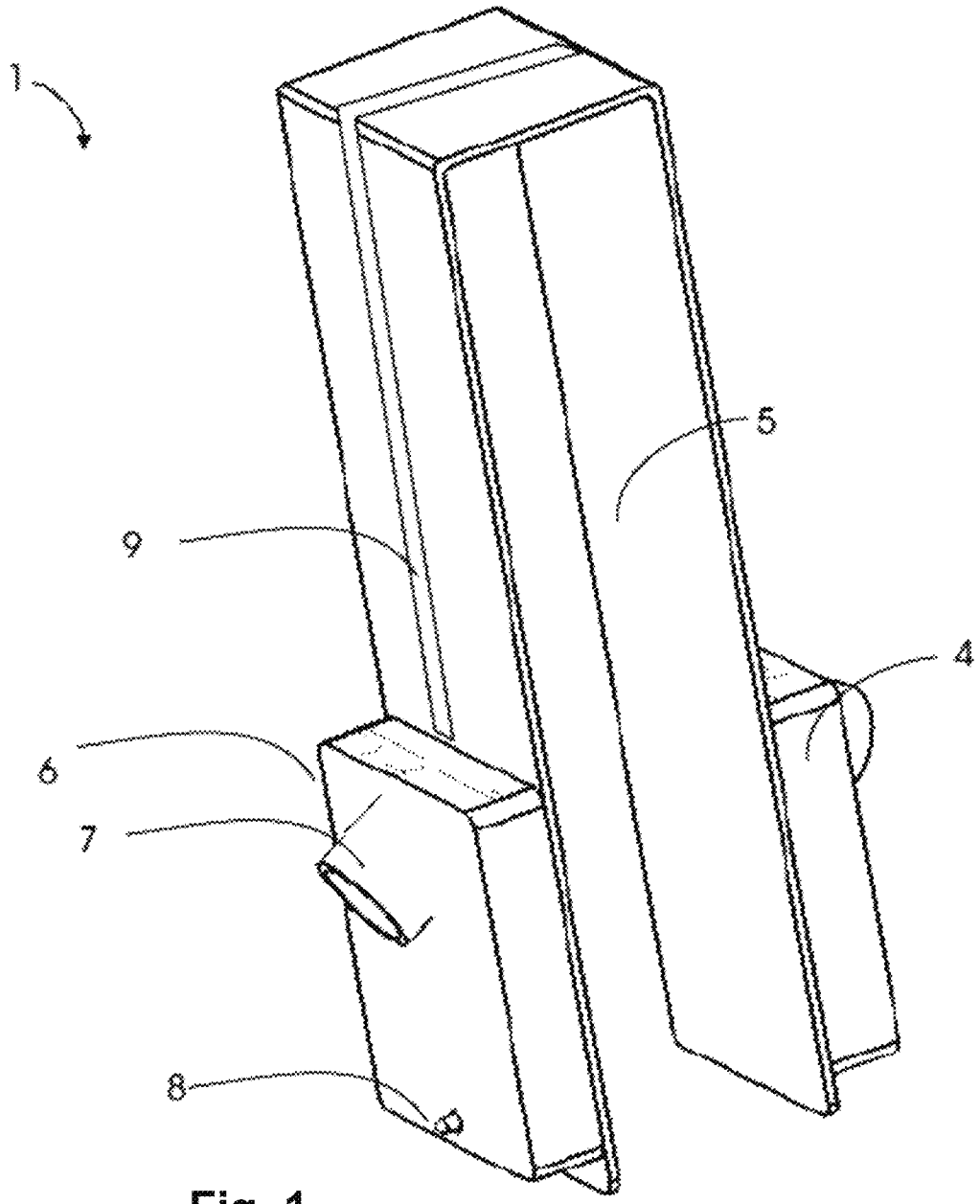
FIG. 1 is a perspective view of a first embodiment of a door collision warning device configured to be mounted over the top of a door.
Figure 2:
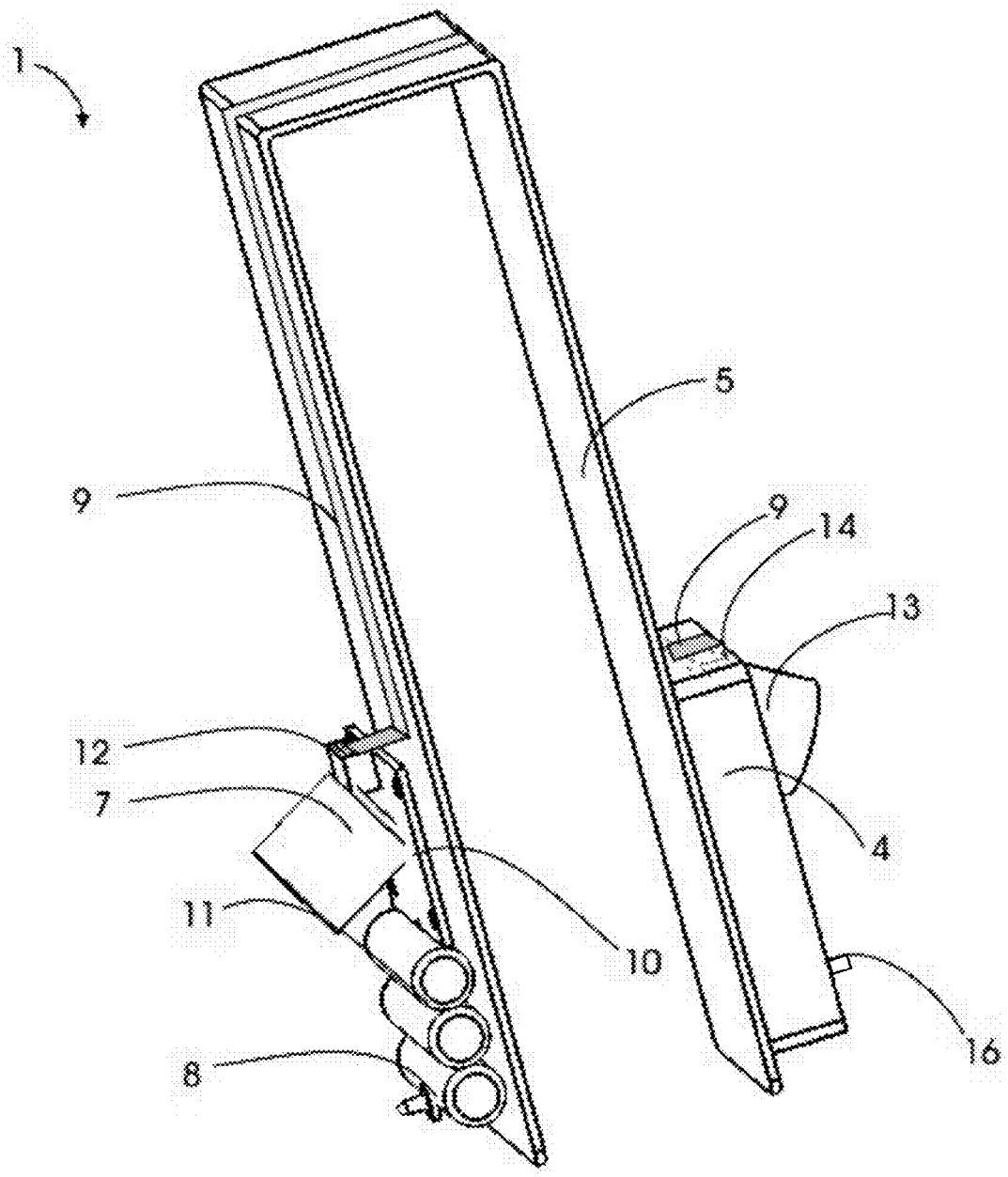
FIG. 2 is a different perspective view than FIG. 1 and shows internal components of one enclosure.
Figure 5:
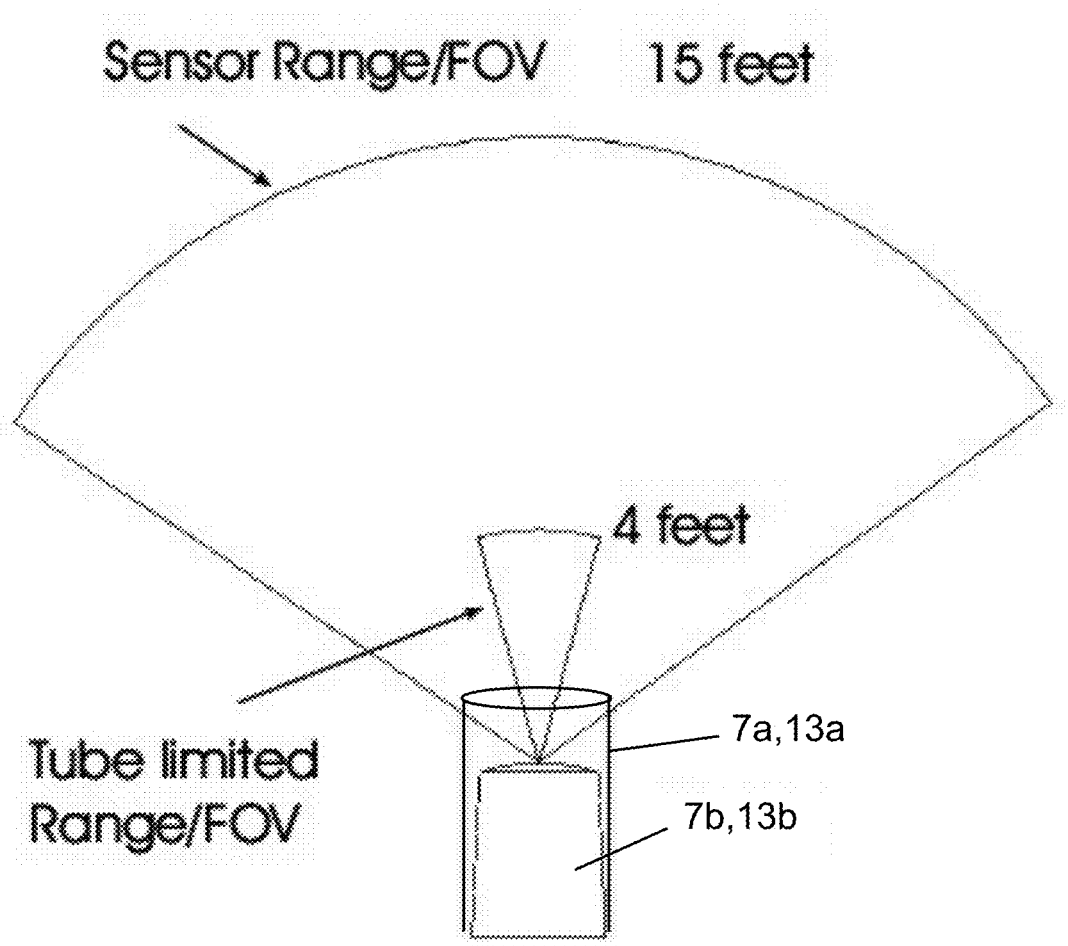
FIG. 5 is a diagram illustrating an example of a field of view limiting tube.
Figure 6:
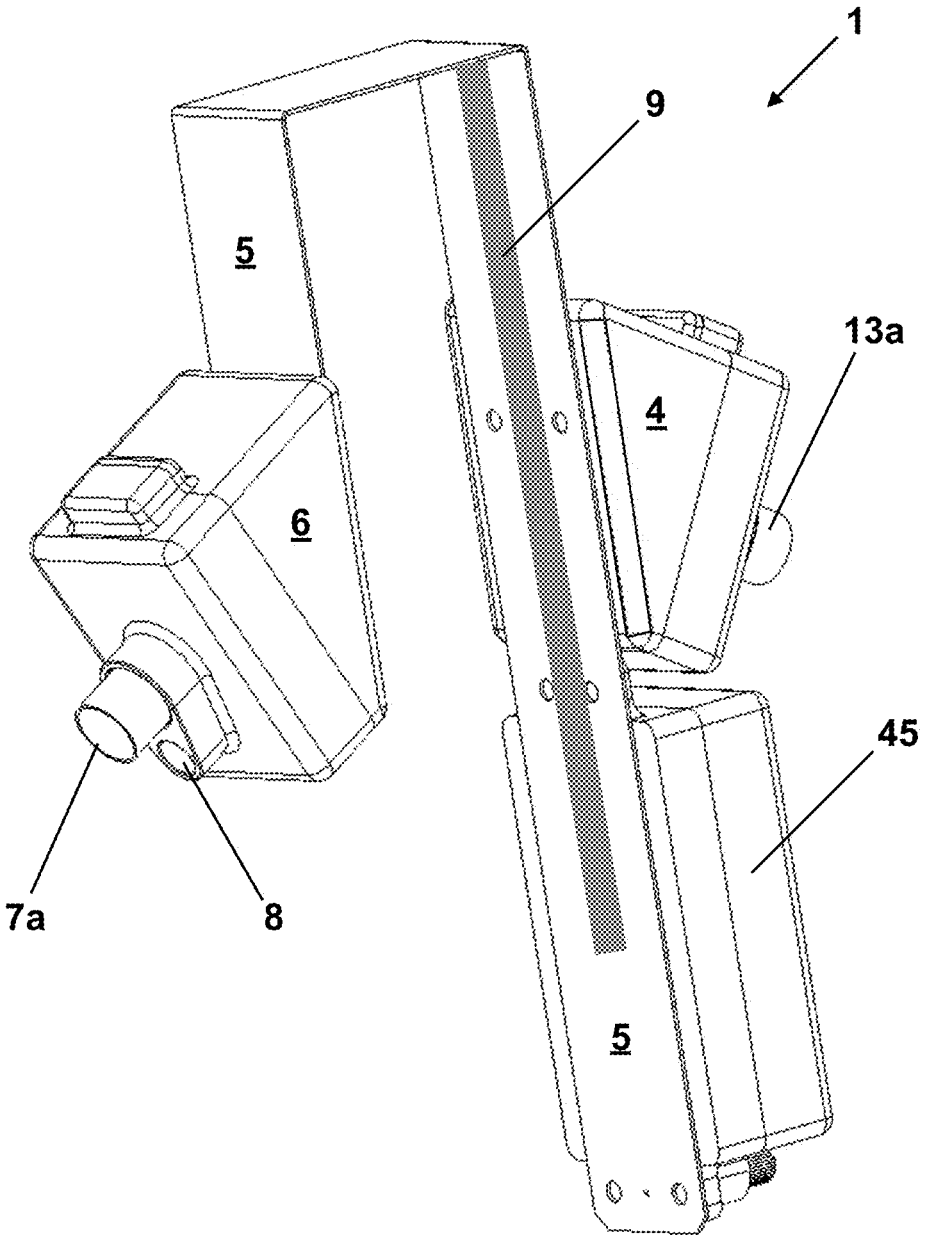
FIG. 6 is a perspective view of a second embodiment of a door collision warning device configured to be mounted over the top of a door.

FIGS. 1 and 2 show an example of a self-contained collision warning device (1) according to the invention that is designed to warn of possible collisions on either side of a swinging door. The phrase "self-contained" is used to indicate that the device operates using power from its own power supply without power from an external power source and without input from an operator once the device is put into operation. The door warning device comprises a support structure (5), which in this embodiment is a hanging bracket configured to fit over the top of a door and hang down on opposite sides of the door. The support structure may be made of metal, plastic, or other suitable material capable of supporting the other components of the device (1). In this embodiment, sensors and indicators are contained within enclosures (4,6) attached to the support structure (5). A first enclosure (6) houses a first sensor assembly (7) and a first indicator (8). A second enclosure (4) similarly houses a second sensor assembly (13) and a second indicator (16). The sensor assemblies (7, 13) each comprise a sensor (7*b*,13*b*) (FIG. 5) suitable for detecting the presence of an object or person, such as a motion sensor or an ambient heat sensor. The indicators (8,16) may each independently comprise visual indicators such as a light emitting diode (LED) or other light, an audible indicator, or both. An indicator comprising a sound generator such as a whistle, buzzer, or other electrically generated sound may be useful for warning people with vision impairments and/or to gain the attention of those preoccupied with their mobile phones, for example. A cable (9) carries electrical signals and electrical power between components on the first and second sides of the device. The cable (9) is shown as running along an outside surface of the support structure (5) but may also be positioned to run along the opposite, inside surface of the support structure (5) as shown in FIG. 6, or along an edge of the support structure (5). The cable (9) may comprise wires, which may be arranged to run parallel to one another to provide a minimal thickness along the surface of the structural support (5). The embodiment shown in FIGS. 1 and 2 comprises housings (4,6), each enclosing both a sensor assembly (7,13) and an indicator (8,16). In other embodiments, sensors and indicators may be contained in separate housings.

The first and second sensor assemblies (7,13) each comprise a printed circuit board (PCB) (10,15), which comprise a connector (12,14) that connects the PCB to cable (9). A power supply (11) powers the electrical components of the device (1). The power supply (11) is illustrated in FIG. 2 as a single array of batteries. Other possible arrangements for the power supply (11) may include separate power supplies for different components or combinations of components, a backup power supply, and/or other types of power supplies such as fuel cells and solar cells.

Figure 3:
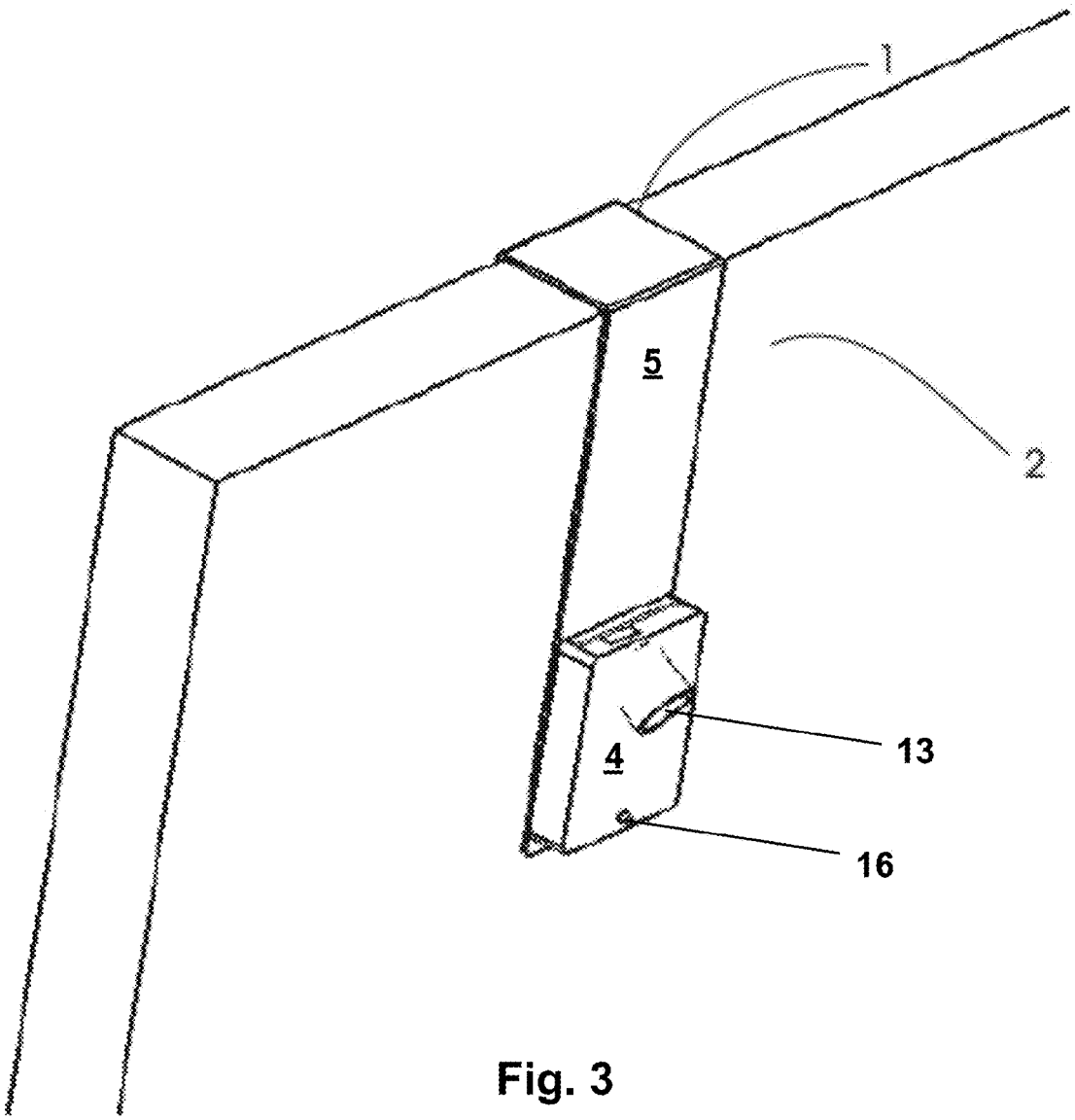
FIG. 3 is a perspective view of an embodiment of a door collision warning device mounted on a door.

FIG. 3, shows the second side of an embodiment of a door collision warning device (1) mounted to a door (2). The door (2) shown in FIG. 3 may be any type of swinging door, including any of a number of standard swinging doors typically found in the interiors and on the exteriors of commercial buildings and homes. The second enclosure (4) is arranged on the structural support (5) so that the sensor assembly (13) faces away from the door in a downward direction. Similarly, the first enclosure (6) is arranged on the structural support (5) so that the sensor assembly (7) faces away from the door in a downward direction.

Figure 4:
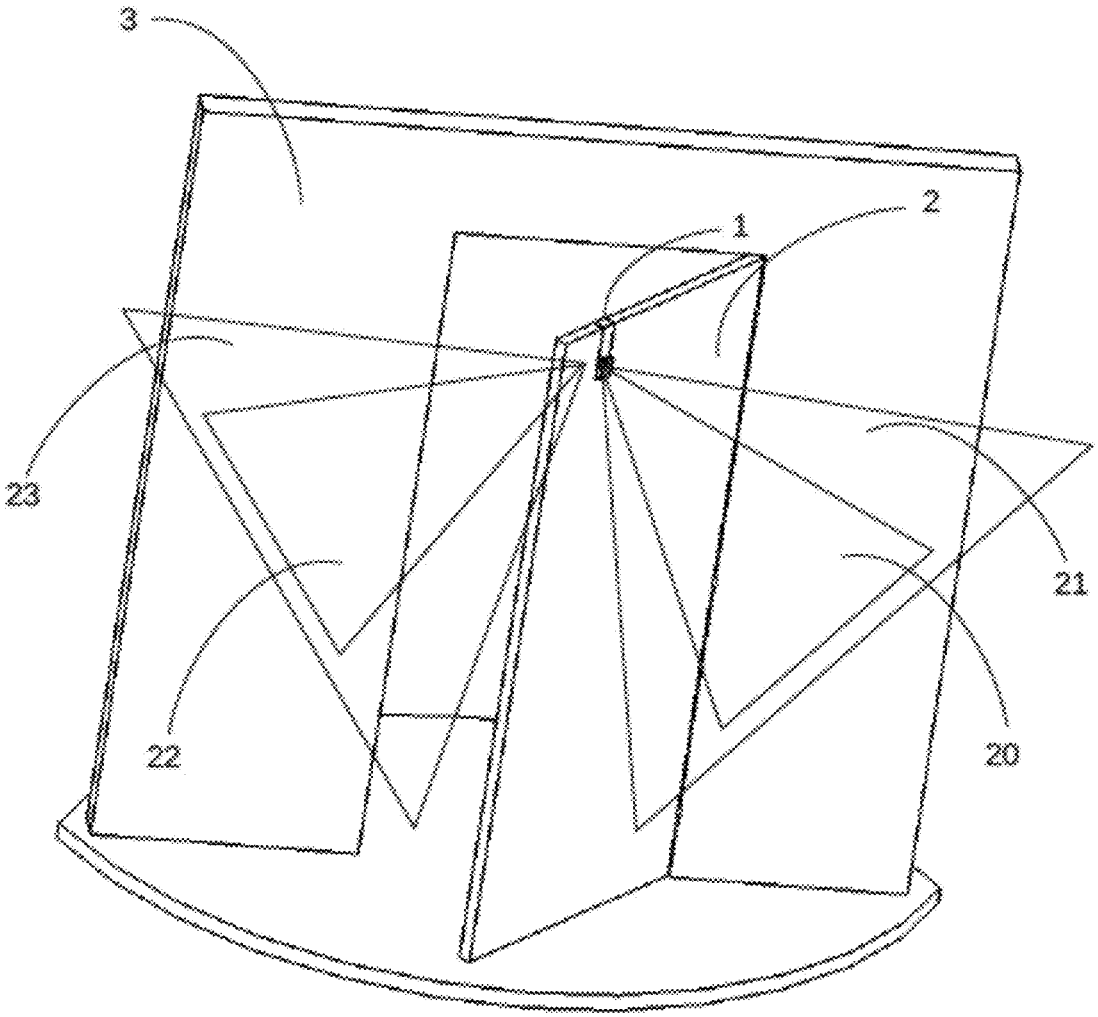
FIG. 4 is a perspective view of an embodiment of a collision warning device mounted to a door and illustrating sensing areas and indicating areas.

FIG. 4 shows a wall (3) with a standard solid door (2) upon which a collision warning device has been mounted. Mounting of the device to the door may be accomplished by simply placing the device on the door by slipping the support structure (5) over the top of the door. If desired, additional securing means may be used to secure the position of the device on the door, such as two-sided tape, adhesive buttons, Command Strips®, and the like. The orientation of the collision warning device (1) is the same as shown in FIG. 3. Sensing cone (20) shows an active detection (or sensing) area of the second sensor assembly (13) on the second side of the door (2). An illumination cone (21) shows an active area of illumination for the second indicator (16) which, in this embodiment is a LED. Sensing cone (22) shows an active detection area for sensor assembly (7) on the first side of the door (2). Illumination cone (23) shows an active area of the first indicator (8) which, in this embodiment is a LED. Sensor assemblies (7,13) are angled downward and each sensor assembly comprises a tubular field of view (FOV) limiter (7*a*,13*a*) that determines the angle and FOV of the corresponding sensing cone. The FOV limiter may be fixed or adjustable relative to the sensors (7*b*,13*b*) of the sensor assemblies (7,13) such that one or more of the sensing cones (20,22) can be adjusted to reduce false warnings and/or failures to warn of possible collisions. For example, the FOV limiter may be attached to the sensor by a threaded connection that allows the FOV limiter to be rotated with respect to the sensor to change the position of the FOV limiter with respect to the sensor. In this context, "tubular" is not intended to be limited to cylindrical tubes having a circular cross-section. The FOV limiter need not be circular in cross section any may be a tube having a an elliptical, square, rectangular, or irregularly shaped cross-section. The resulting FOV may have a shape other than a cone and may be symmetric or asymmetric with respect to a line from the center of the sensor to the center of the FOV at the detection limit distance. When a person approaches the door (2) from the right side as shown in FIG. 4, the sensor (13*b*) detects the presence of that person when the person enters into the corresponding sensing cone (20). Similarly, a person approaching the door from the left side as shown in FIG. 4. is detected by the sensor (7*b*) when the person enters into the corresponding sensing cone (22). If a person is pushing or carrying a movable object such as a cart of tray, the movable object will additionally or alternatively activate the sensor.

In a preferred embodiment, each of the sensor assemblies (7,13) comprises a passive infrared sensor (PIR) to sense the presence of a person or moving object on either side of the door. PIR sensors do not image an area but integrate the total energy within the sensor's field of view (FOV), to establish a baseline level for sensing. When someone or something enters the FOV, the total energy is either increased or decreased, resulting in a change of energy level. This change, often called motion detection, is sensed and the sensor emits an output in the form of an electrical signal indicating that the integrated total energy in the FOV has changed. Standard PIR sensors are relatively inexpensive but are designed for use in area motion detection for alarm and lighting systems. These applications require sensors that have a relatively wide FOV and typically detect movement across a distance of 15 to 30 feet. PIR sensors are therefore not suitable for the present application without modification because the collision warning device requires smaller angle FOV and shorter detection distances to avoid falsely warning of possible collisions with people or objects that are far away from the potential collision area. FIG. 5 illustrates the limitation of the FOV and detection distance by the FOV limiters (7*a*,13*a*). The diameter and length of the tube can be adjusted for the desired range and FOV to meet the requirements of the door warning device blind corner warning device. The detection distance shown in FIG. 5 is 4 feet as an example only. The detection distance and cone sizes and shapes may be selected to suit particular spaces and populations. For example, sensing cones may be set lower in areas frequented by small children and a shorter detection distance may be selected for a door near an area of heavy traffic near to but not leading to the door. Examples of detection distances may include less than 0.5, 1, 1.5, or 2 meters, for example. Swinging a door (2) equipped with a device comprising PIR sensors causes a relative motion between the sensors and objects in their FOV. This motion causes both sensors to issue a positive signal in the same manner as when a person approaches the door from each side of the door.

FIGS. 1 and 2 show an embodiment of a collision warning device comprising enclosures (4,6) that house sensor assemblies (7,13) and indicators (8,16). FIG. 6 shows an embodiment of a collision warning device comprising an additional enclosure (45) for housing the power supply (11) and other electronics separately from enclosures (4) and (6). In some embodiments, one or the other of enclosures (4,6) may be used house components in addition to sensors and indicators. The enclosure (45) shown in FIG. 6 may contain, for example, a power supply (11) providing power to the device (1) and a microprocessor (64) for controlling the operation of the device. In other embodiments, the enclosure (45) may additionally contain a voltage regulator (61) and/or a motion detection means 65, such as an accelerometer, gyroscope or pendulum (FIG. 7).

Figure 7:
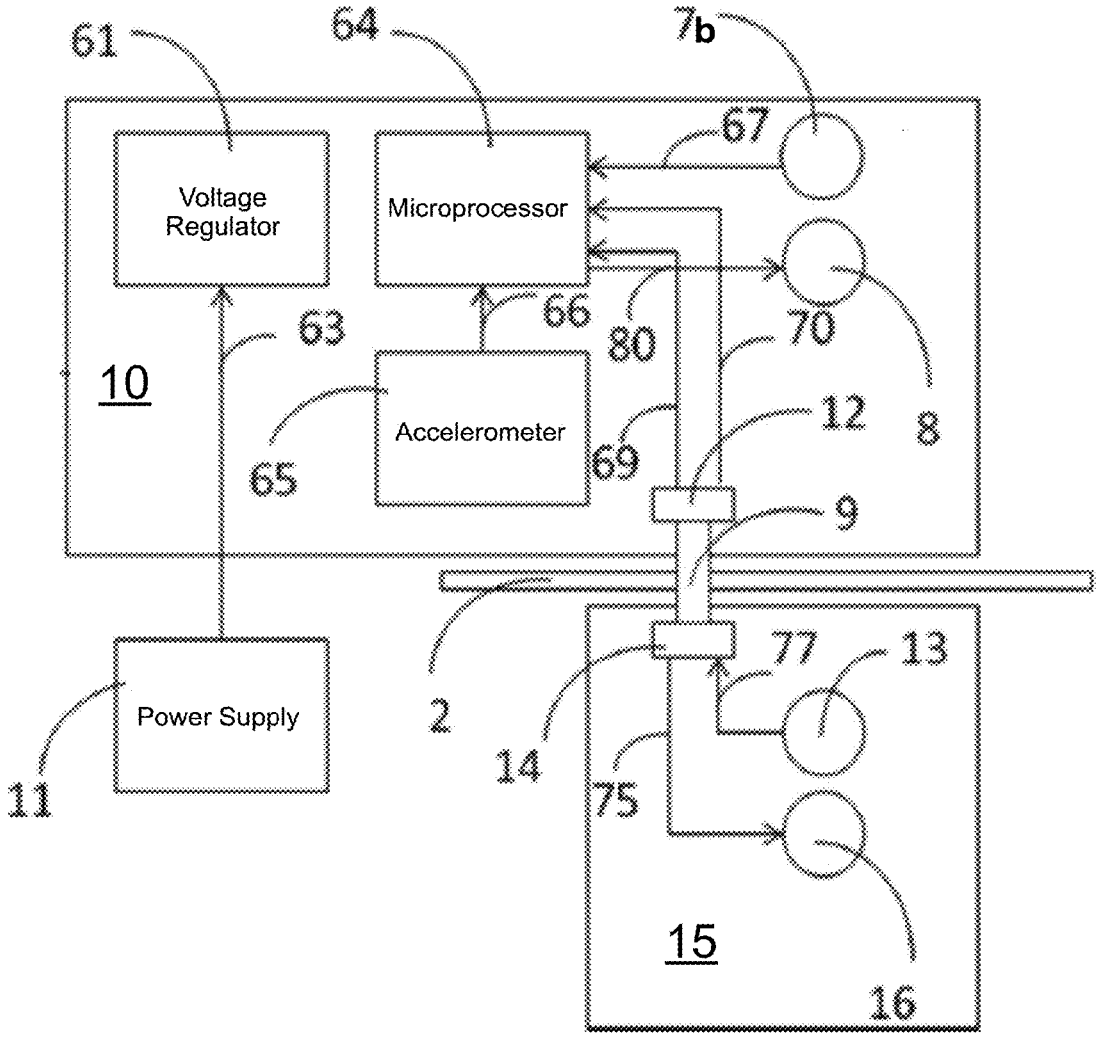
FIG. 7 is a block diagram showing connectivity of components for embodiments of collision warning devices for mounting on doors.
Figure 8:
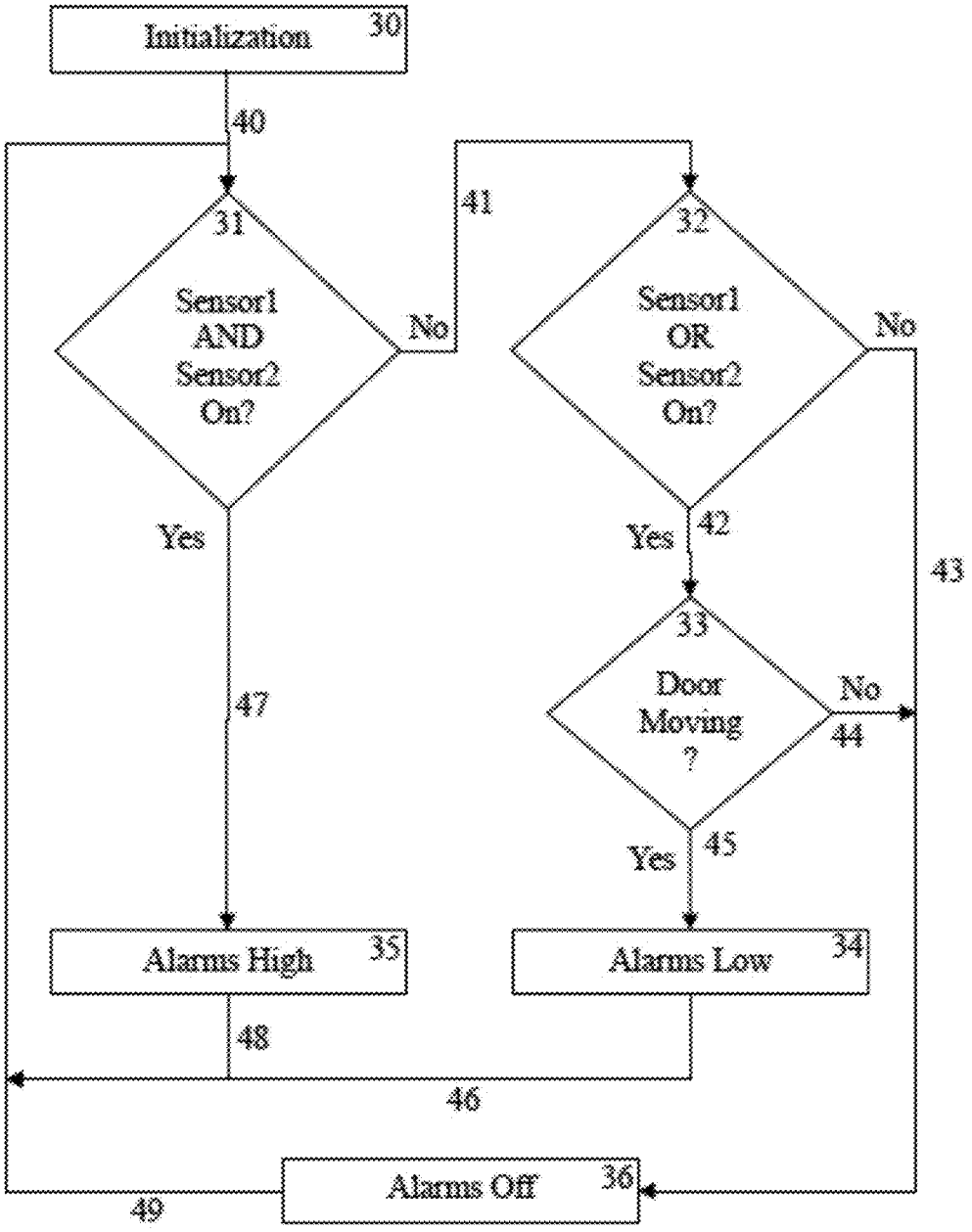
FIG. 8 is a flow chart illustrating processes performed by embodiments comprising an accelerometer, pendulum, or gyroscope.

FIG. 7 is a block diagram showing the electrical components of an embodiment of a door collision warning device comprising an accelerometer as a door motion detection means (65), a voltage regulator (61), and a microprocessor (64) connected to the first PCB (10) of the first sensor assembly 7. The voltage regulator (61) conditions voltage from power supply (11) to provide a stable, constant voltage to the electronics. A microprocessor (64) comprises firmware for controlling the electronics. The door motion detection means (65) in this embodiment is an accelerometer that provides simultaneous acceleration measurements in 3 axes to the microprocessor (64) to sense movement of the door when the door is pushed by a person. In another embodiment, the door motion detection means (65) may comprise a gyroscope, a rate gyroscope, or a pendulum. In a preferred embodiment, the door motion detection means (65) is omitted, for example when sensors (7*b*,13*b*) are PIR or functionally similar motion sensors. Connectors (12) and (14) provide a means to electrically connect first PCB (10) with second PCB (15). Traces (75,77) on PCB 15 connect signals to and from the sensor assembly (13) and indicator (16) to connector (14). Traces (63,66,67,69,70,80) on PCB (10) connect signals to and from electrical components on the first PCB (10) to connector (12). The microprocessor (64), voltage regulator (61), and door motion detection means (65) in are shown as connected to PCB (10) but may alternatively be connected to PCB (15) or may be located in a separate housing and connected to one or more of PCB (10) and PCB (15). The microprocessor (64) is in communication with PCBs (10,15) and operates to activate the indicators (8,16) as shown in FIG. 8.

The device is initially powered on, the software initializes all hardware (30), and begins operation (40). If neither of sensors (7*b*,13*b*) detects a person or movement, the microprocessor (64) and door motion detection means (65) are placed in a low power mode. When either of the sensors (7*b*,13*b*) detects a person or motion, the microprocessor is activated to perform a test (31) to determine if both of the sensors detects a person or movement. If yes (47) (i.e. both sensors (7*b*,13*b*) have been activated), both of the indicators (8,16) are activated as a high alarm to warn the people present on both sides of the door that the door may soon open. Provided with this active warning, a person intending to operate the door may be prevented from rapidly opening door and striking a person or object carried by a person on the other side. If a person is not present on each of both sides of the door (41), a test is performed (32) to determine whether there is a person present on either side of the door. If only one person is present, as indicated by the activation of only one of the sensors (7*b*,13*b*), the door motion detection means (65) is activated and a further test is performed to determine whether the door is moving (33). If yes (45), then the alarm is turned to low mode (34), in which only the indicator (8,16) on the opposite side of the door from the person is activated to warn anyone heading for the door that it is moving. If no person is present at either side of the door (43) or the door is not moving (44), the alarm is turned off (36). The process is repeated through (46) (48) or (49) to test for the presence of a person on each of both sides of the door (31).

Figure 9:
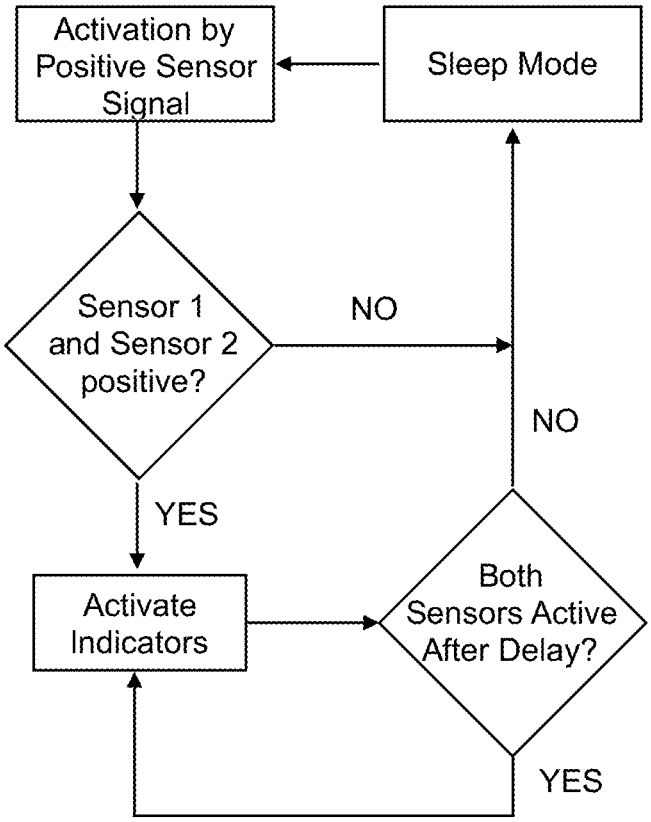
FIG. 9 is a flow chart illustrating processes performed by embodiments not comprising an accelerometer, pendulum, or gyroscope.

FIG. 9 is a flow chart showing steps performed by a microprocessor in the operation of a preferred embodiment of a collision warning device for a door in which each of the sensor assemblies (7,13) comprises a motion detection sensor, such as a PIR sensor, in which no separate door motion detection means (65) is present. Providing power to the circuitry causes the system to initialize the hardware. A test is performed to determine whether or not a person is present on a first side of the door. If not, as indicated by the lack of a positive signal from either of sensors (7*b*,13*b*), the microprocessor enters a low power sleep mode. If a person is detected on the first side of the door, a further test is performed to determine whether or not a person is present on the second side of the door. If yes, as indicated by positive signals from both sensors (7*b*,13*b*), indicators (8,16) on both sides of the door are activated until the presence of either one of the people is no longer detected, as indicated by either one of the sensors no longer providing a positive signal. At this points a predetermined delay period is stared and, if both sensors (7*b*) and (13*b*) are not activated by the end of the delay period, the device returns to sleep mode. If only one of the sensors continues to issue a positive signal, the system will immediately awaken and begin the process again.

Figure 10:
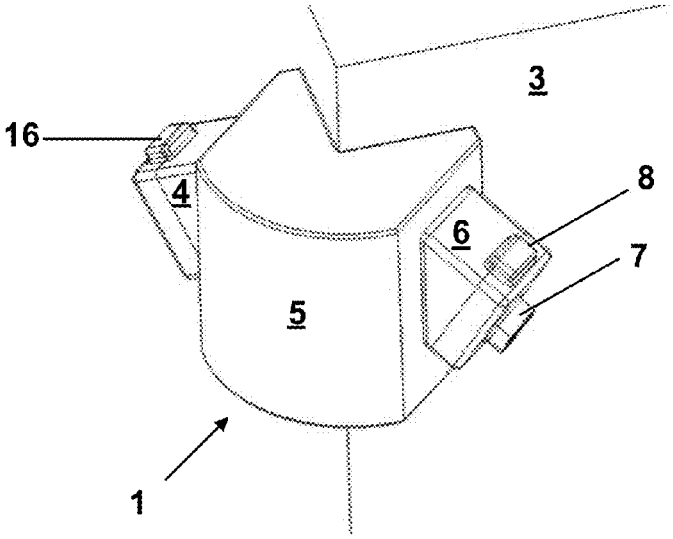
FIG. 10 is a top perspective view of a collision warning device for mounting at an intersection of two hallways.
Figure 11:
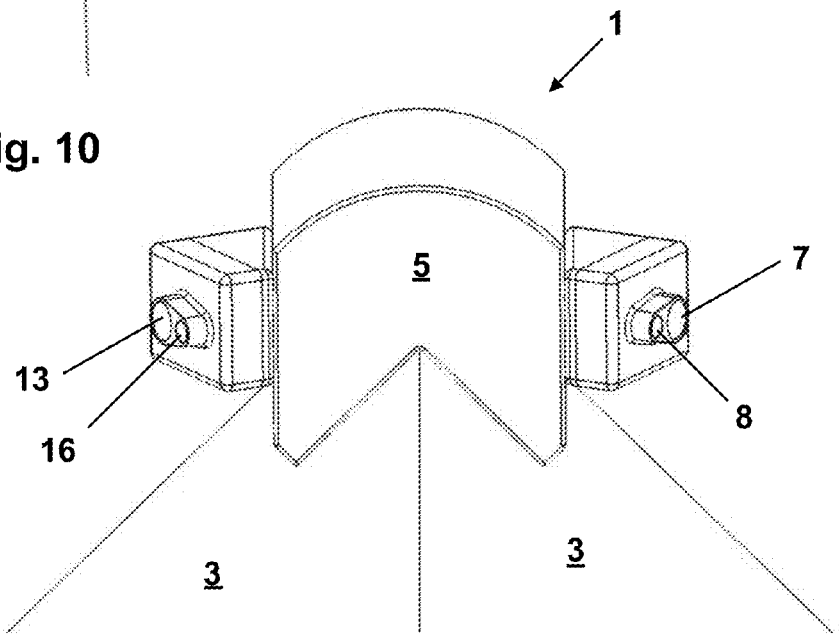
FIG. 11 is a bottom perspective view of a collision warning device for mounting at an intersection of two passages.

FIGS. 10 and 11 show an embodiment of a self-contained collision warning device for mounting on a motionless surface between two areas separated by a visual barrier. This embodiment comprises a structural support (5) shaped to fit over an angled surface at a corner where two walls (3) of a passage, corridor, or hallway meet. The structural support (5) may be mounted to the walls (3) using an adhesive, two-sided tape, or hung on a screw or nail in the walls (3) via one or more holes in the back of the structural support (5). This embodiment differs from embodiments for mounting on the top of a door as shown in FIGS. 1-4 and 6 by having a structural support (5) that also serves as an enclosure, or housing, that contains a power supply (11) and microprocessor (64) in additional to supporting enclosures (4) and (6). As with the embodiments shown in FIGS. 1-3, the enclosures (4,6) each comprise an indicator (8,16) and sensor assembly (7,13) comprising a sensor (7*b*,13*b*) and a tubular FOV limiter (7*a*,13*a*). The embodiment shown in FIGS. 10 and 11 illustrates that each of enclosures (4,6) may comprise more than one indicator (8,16). For example, each of the enclosures may independently comprise one visible and one audible indicator, two visible indicators, or two audible indicators producing the same or different sounds. In this embodiment, the support structure is configured for mounting at a corner where two passages meet at an angle, with sensing and indicating cones directed toward the passages. This embodiment may be modified for mounting on an inside corner where two walls meet rather than an outside corner. For such an embodiment, the first and second sensor assemblies would be directed downward and slightly away from the walls to which the device is mounted. The collision warming device may also be adapted for mounting to a curved surface in a curved hallway, for example, or on other motionless visual barriers separating two areas that are not visible from one another.

Figure 12:
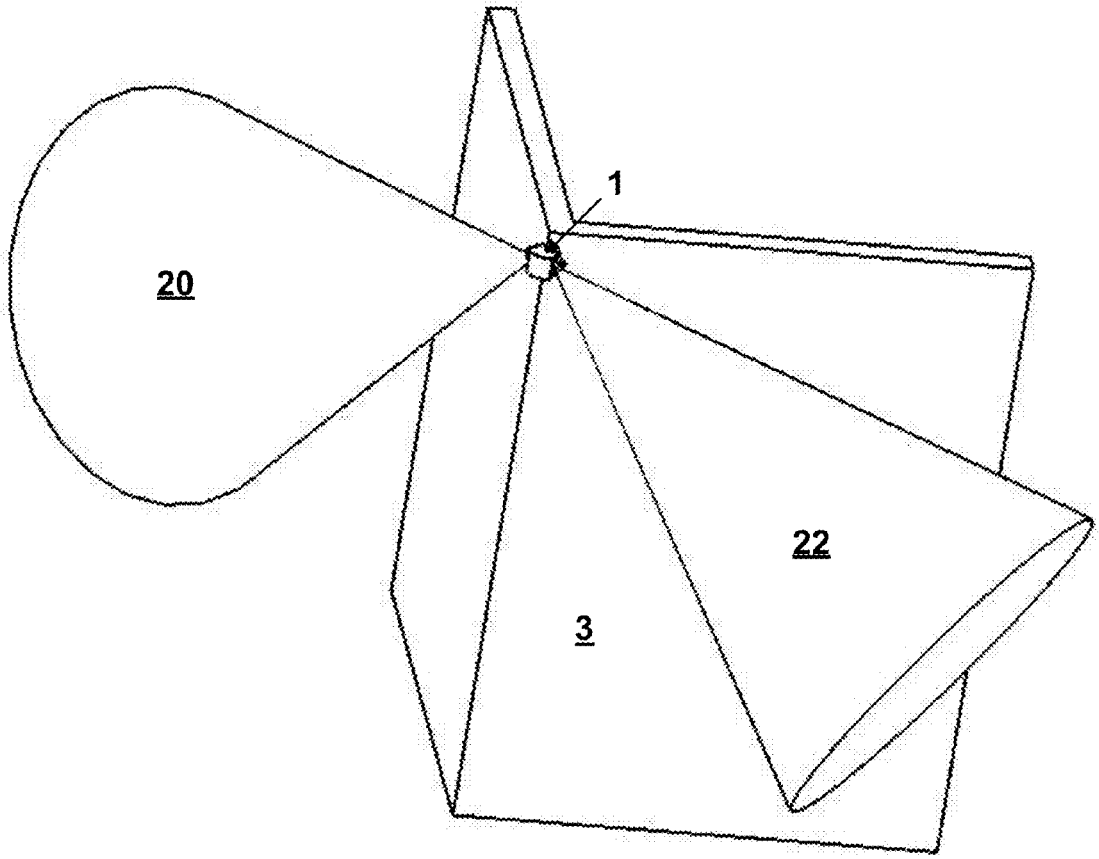
FIG. 12 illustrates detection areas for an embodiment of a collision warning system for the intersection of two passages.

FIG. 12 shows two wall (3) meeting at a corner such that a person approaching the corner from either the left or the right cannot see if anyone is approaching from the other side. Mounting of the device 1 to the corner may be accomplished by simply adhering the device to the wall using double-sided tape applied to the support structure (5). Additionally or alternatively, securing means such as screws or nails may be used to secure the position of the device on the wall. Sensing cone (20) shows an active detection (or sensing) area of the second sensor assembly (13) and sensing cone (22) shows an active detection area for sensor assembly (7). When a person approaches the corner from the left side as shown in FIG. 12, the sensor (13*b*) detects the presence of that person when the person enters into sensing cone (20). Similarly, a person approaching the corner from the right side as shown in FIG. 12. is detected by the sensor (7*b*) when the person enters into sensing cone (22). When both sensors are activated at the same time, indicators (8,16) emit a visual and/or audible indication warning of a potential collision in a manner analogous to that shown in FIG. 9. In this case, however, the sensors (7*b*,13*b*) cannot be activated by movement of the surface to which the device (1) is attached.

The invention claimed is:

1. A self-contained collision warning device comprising:

a support structure supporting a power supply, a microprocessor, a first motion sensor having a first field of view (FOV), a second motion sensor having a second FOV, a first indicator, and a second indicator wherein:

the first motion sensor and the first indicator are positioned on a first side of the support structure;

the second motion sensor and the second indicator are positioned on a second side of the support structure such that the first FOV and the second FOV are non-overlapping;

the power supply provides power to the microprocessor, the first motion sensor, the second motion sensor, the first indicator, the second motion sensor, and the second indicator; and the microprocessor is operationally coupled to the first motion sensor, the second motion sensor, the first indicator, and the second indicator and activates the first indicator and the second indicator when both the first motion sensor and the second motion sensor detect motion.

2. The self-contained collision warning device of claim 1, wherein the support structure is shaped to fit over the top of a swinging door and between the door and a door frame such that the first motion sensor and the first indicator are positioned on a first side of the door and the second motion sensor and the second indicator are positioned on a second side of the door opposite the first side.

3. The self-contained collision warning device of claim 2, wherein movement of the swinging door activates the first motion sensor and the second motion sensor to indicate detected motion.

4. The self-contained collision warning device of claim 2, further comprising a door motion detection means selected from the group consisting of a pendulum, an accelerometer, a gyroscope, and a rate gyroscope and wherein the microprocessor activates the second indicator when the first motion sensor and the door motion detection means both detect motion.

5. The self-contained collision warning device of claim 1, wherein the support structure is shaped for mounting to an inside or outside corner of an intersection of a first wall and a second wall such that the first FOV is directed to an area in apposition to the first wall and the second FOV is directed to an area in apposition to the second wall.

6. The self-contained collision warning device of claim 1, wherein the first motion sensor and the second motion sensor are each a passive infrared motion sensor.

7. The self-contained collision warning device of claim 1, wherein the first indicator and the second indicator each comprise a light emitting diode (LED).

8. The self-contained collision warning device of claim 1, wherein the first indicator and the second indicator each comprise a sound generator.

9. The self-contained collision warning device of claim 1, wherein the first FOV and the second FOV are each a cone having a detection distance of less than 2 meters.

* * * * *